United States Patent [19]

Bengtsson

[11] Patent Number: 4,641,718

[45] Date of Patent: Feb. 10, 1987

[54] ROTARY DRILL BIT

[75] Inventor: Ulf A. Bengtsson, Motala, Sweden

[73] Assignee: Santrade Limited, Lucerne, Switzerland

[21] Appl. No.: 735,997

[22] Filed: May 20, 1985

[30] Foreign Application Priority Data

Jun. 18, 1984 [SE] Sweden ..... 8403242

[51] Int. Cl.[4] ..... E21B 10/16

[52] U.S. Cl. ..... 175/331; 175/353

[58] Field of Search ..... 175/331, 376, 353, 354, 175/348, 336, 367–369, 374

[56] References Cited

U.S. PATENT DOCUMENTS

| | | | |
|---|---|---|---|
| 1,238,757 | 9/1917 | Gardner | 175/376 |
| 1,859,948 | 5/1932 | Zublin | 175/348 |
| 2,058,749 | 10/1936 | Williams et al. | 255/71 |
| 2,336,335 | 12/1943 | Zublin | 175/354 |
| 2,362,860 | 11/1944 | Rossman | 175/348 |
| 3,126,066 | 3/1964 | Williams, Jr. | 175/336 |
| 3,726,350 | 4/1973 | Pessier | 175/376 |
| 3,858,670 | 1/1975 | Ott et al. | 175/374 |
| 4,089,382 | 5/1978 | Pessier | 175/374 |
| 4,154,312 | 5/1979 | Barnetche | 175/354 |
| 4,187,922 | 2/1980 | Phelps | 175/376 |
| 4,248,314 | 2/1981 | Cunningham et al. | 175/376 |

*Primary Examiner*—Stephen J. Novosad
*Assistant Examiner*—Bruce M. Kisliuk
*Attorney, Agent, or Firm*—Burns, Doane, Swecker & Mathis

[57] ABSTRACT

A rotary drill bit comprising a cutter bit (10) having a plurality of mutually displaced rows (12–17) of cutting means (11) extending in the circumferential direction of the cutter bit (10). The included cone angle ($\alpha$) of the cutter bit (10) is larger than 90° and adapted to the mutual positioning of the cutting means (11) on the cutter bit (10) in such a way that it is ensured that repetition of the pattern of the cutting means is avoided.

9 Claims, 5 Drawing Figures

ROTARY DRILL BIT

BACKGROUND AND OBJECTS OF THE INVENTION

The present invention relates to a rotary drill bit comprising a cutter bit having a plurality of rows of cutting means. These rows extend along the circumference of the cutter bit and are mutually displaced generally in the axial direction of the cutter bit. The cutter bit is rotatably carried by a bit body over a bearing system, and is generally conical with an included cone angle larger than 90°. The invention further relates to the use of such a drill bit as centric member in a larger unit or as an independently working unit.

Drill bits of this prior art type are disclosed in for instance U.S. Pat. Nos. 1,238,757, 2,336,335, 2,598,518 and 4,154,312. However, these previously known drill bits have been commercially used to only a limited extent due to their comparatively low drilling rate.

One object of the invention is therefore to provide a rotary drill bit of this type which has a drilling rate larger than that of hitherto known drill bits.

Boring heads having a plurality of roller cutters wherein the centric member is a one-sidedly carried conical roller cutter are disclosed in for instance U.S. Pat. No. 3,385,385 and DE-A No. 3131201. Due to the high axial feeding forces applied on such boring heads during drilling it has been found that these centric roller cutters have an unsatisfactory life.

Another object of the invention is therefore to provide a rotary drill bit of the type in question which allows use of high feeding forces while maintaining a satisfactory life.

A further object of the invention is to provide a rotary drill bit wherein the cutter bit is easily detachable from its supporting device.

THE DRAWINGS

The invention is described in detail in the following description with reference to the accompanying drawings in which various embodiments are shown by way of example. It is to be understood that these embodiments are only illustrative of the invention and that various modifications thereof may be made within the scope of the claims.

In the drawings

DESCRIPTION OF PREFERRED EMBODIMENTS OF THE INVENTION

Figure 1:
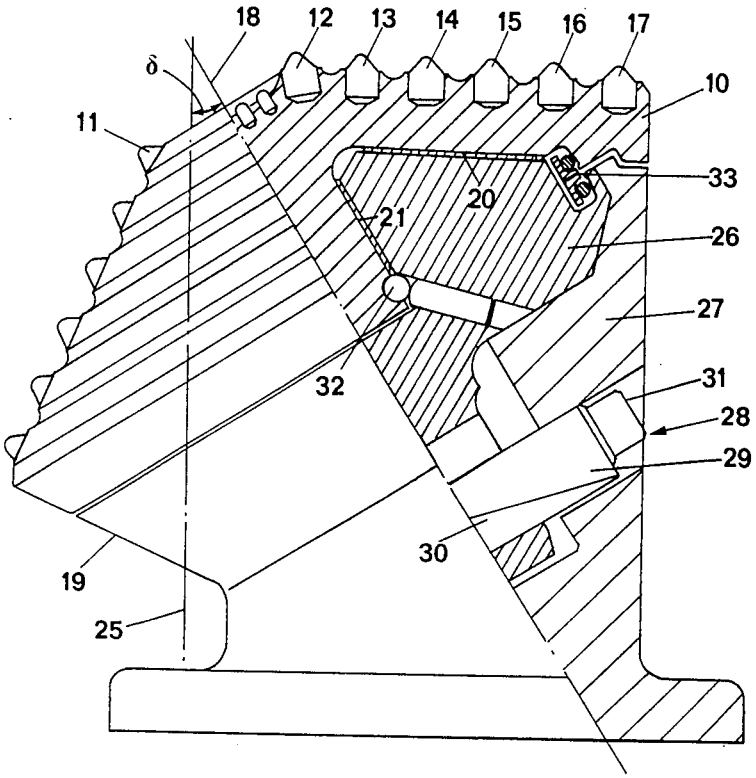
FIG. 1 shows a side view, partially in section, of a rotary drill bit according to the present invention.

In the drawings the cutter bit or roller cutter generally denoted by 10 is provided with cutting means 11 arranged in rows 12–17, which are mutually displaced, generally seen, in the axial direction 18 of the cutter bit 10. The cutting means 11, which in the illustrated embodiments are cylindrical hard metal inserts mounted in a manner known per se by press fit in the cutter bit 10, are substantially equally spaced in each row along the circumference of the cutter bit 10. The cutter bit 10 is rotatably carried by a bit body 19 over a bearing system, which comprises two friction bearings 20,21. The friction bearing 20 is conical and in the illustrated embodiment parallel to the conical surface 22 of the cutter bit 10. The friction bearing 21 is substantially cylindrical and in the illustrated embodiment parallel to the rotational axis 18 of the cutter bit 10. The friction bearings 20,21 are sleeve-shaped and attached to either of the cutter bit 10 or the bit body 19.

Figure 2:
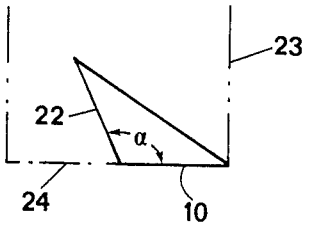
FIGS. 2 and 3 illustrate the included cone angle of the cutter bit.
Figure 3:
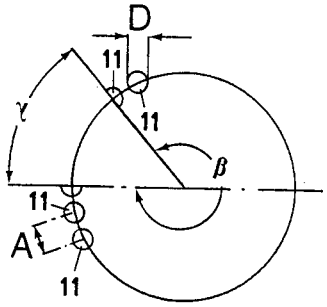

The cutter bit 10 is generally conical, and the cone angle $\alpha$ confined by the conical surface 22 exceeds 90°. In FIG. 2 the position is shown of the cutter bit 10 in its working cylinder 23, i.e. the imaginary cylinder generated by the cutter bit during its rotation and axial displacement. In FIG. 3 the extension of the cone 10 is shown, i.e. the sector having the angle $\beta$ covered by the cone during one revolution thereof about the axis 18. This sector could also be defined as the sector covered by the envelope surface of the cutter bit 10 when the envelope surface is unrolled in the working surface 24. The sector not covered by the extension of the cone 10 in the working surface 24 is denoted by the angle $\gamma$. Due to the fact that the cutting means 11 are located in rows 12–17 at substantially constant distances to the rotational axis 18 throughout the length thereof, said cutting means in the preferred embodiment being cylindrical hard metal inserts press-fitted in bores in the cutter bit 10, the cutting means are adapted to be brought to regular indentations in the working surface so as to create circular grooves having intermediate ridges. During continuous drilling these ridges are broken under the force of cooperating or separate rows of inserts while simultaneously creating new ridges.

It has been found important to design the insert pattern such that the inserts 11 in one and the same row form new indentations during the rotation of the cutter bit 10, i.e. it must be avoided that the inserts do enter indentations already created. In the last-mentioned case the inserts 11 would form deeper and deeper indentations until the portions of the cutter bit 10 between the inserts came into contact with the rock, which would drastically reduce the drilling rate.

According to the present invention it is ensured that the inserts 11 do not enter indentations already formed, i.e. it is ensured that continuous grooves are produced by the inserts in one and the same row. This is attained by providing a cone angle $\alpha$ such that the circumferential extension of one row of inserts 11 denoted by the angle $\gamma$ has a length not smaller than four pitches A and not exceeding twelve pitches A between the inserts in said row. In the illustrated embodiment said row is the radially outermost row 17. It is to be understood that the pitch A means the distance between the centre of two adjacent inserts. In the illustrated embodiment the cone angle $\alpha$ is such that said circumferential extension, which is the periphery of the sector denoted by the angle $\gamma$, has a length somewhat smaller than eleven pitches; the periphery of the shown sector thus relating to the radially outermost row 17 of cutting means. It is believed that the illustrated embodiment shows a design which with regard to the weight is at the upper limit of what is suitable in practice. In smaller constructions, thus, the periphery, i.e. the arc $\gamma$, of the radially outermost row of cutting means will be closer to the lower limit four pitches.

The inserts 11 are generally seen chisel-shaped having the chisel edge oriented in the circumferential direction of the cutter bit 10. The upper limit of the cone angle $\alpha$, i.e. an angle $\gamma$ corresponding to four pitches A, minimizes generally seen the inclination of the axis of the cutter bit toward the limit for repetition of insert pattern, said inclination being the angle $\delta$ between the rotational axis 18 of the cutter bit 10 and the rotational axis 25 of the bit body 19. The lower limit of the cone angle $\alpha$, i.e. an angle $\gamma$ corresponding to twelve pitches A, maximizes generally seen the angle $\delta$ toward the limit for sufficient amount of hard metal and sufficient space for dimensioning of the bearing system 20, 21.

The present invention, thus, teaches the upper and lower limit values of the cone angle $\alpha$ with respect to the pitch between the cutting means which must be met in order to both avoid repetition of insert pattern and allow a bearing system large enough to be used. When it is ensured that the cone angle $\alpha$ is between these limit values the pitch is suitably chosen for each of the rows 12–17 of cutting means. A secondary requirement which must be met is of course that the length of the arc corresponding to the angle $\gamma$ must not be an integer multiple of the pitch.

The insert pattern is determined as above-described for as many as possible, seen in a radially inward direction, rows of cutting means. It is obvious that the radially innermost row or rows of cutting means cannot be given a non-repetitive insert pattern. However, this is of minor importance since the radially outermost rows are totally responsible for the efficiency of the drill bit as to the drilling rate.

Alternatively, the pitch can be defined with reference to the extension of the cutting means 11 in the circumferential direction of the cutter bit 10. Since the cutting means in the illustrated embodiment are cylindrical inserts 11 it is preferred that the pitch is between D and twice D, where D is the diameter of the inserts 11.

In the illustrated embodiment the bit body 19 comprises a member 26 which carries the cutter bit 10 and a member 27 which is attached to a supporting device. The cutter bit 10, bearing system 20,21 and member 26 then form a unit which is detachably connected to the member 27 by means of a wedge lock device 28. The wedge lock device 28 comprises two wedges 29,30, which are displaceable relative to each other by means of a screw 31 threaded into the wedge 30. The cutter bit 10 and the member 26, thus, are a unit which can be readily disassembled from the member 27. The cutter bit 10 is secured to the member 26 by means of balls 32. The bearing space between the cutter bit 10 and the member 26 is sealed by means of a seal 33.

The illustrated wedge lock device 28 can be replaced by other clamping arrangements, for instance a threaded connection. The two friction bearings 20,21 can also be replaced by a roller bearing, preferably a conical one.

Figure 4:
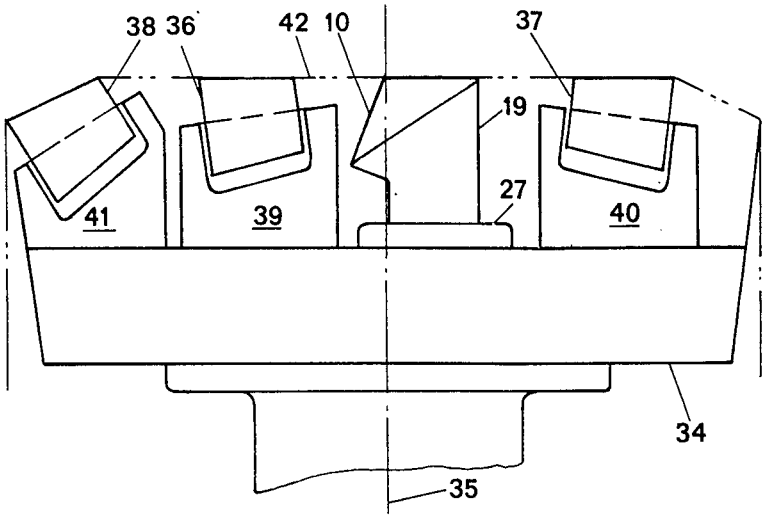
FIG. 4 shows the invention applied as a centric member in a larger unit.

In FIG. 4, a preferred application of the invention is illustrated, where the drill bit 10,19 is a centric member in a larger unit, i.e. a boring head 34 for raise or tunnel boring. The boring head 34 comprises a plurality of roller cutters 36,37 positioned at different distances from the rotational axis 35 of the boring head. The roller cutters 36,37 are rotatably carried in saddles 39,40,41. In similarity to the cutter bit 10 the roller cutters 36, 37,38 have rows of chisel-shaped hard metal inserts extending along the circumference thereof and mutually displaced in the axial direction of the roller cutters. It has been found that the cutter bit 10 allows application of an axial feeding force on the boring head 34 which is as large as the optimal feeding force for the roller cutters 36,37,38, i.e. the cutter bit 10 designed according to the invention has substantially the same life as the roller cutters 36,37,38.

In the embodiment illustrated in FIG. 4 a coherent working profile 42 is obtained, whereas, in the preferred embodiment, at least the working profile created by the cutter bit 10 and the roller cutter 36 located radially outwardly thereof and nearest thereto is perpendicular to the rotational axis 35.

For crushing of the portion of the working front nearest to the cutter bit 10 either two roller cutters of the general type denoted by 36 or only one such roller cutter 36 can be arranged at the top side of the cutter bit 10. The advantage of the first-mentioned configuration, wherein the roller cutters 36 preferably are symmetrically located relative to the centric cutter bit 10, is that it is possible to vary the row distance of the cutters by replacing the centric cutter bit 10 and one of the roller cutters 36.

Figure 5:
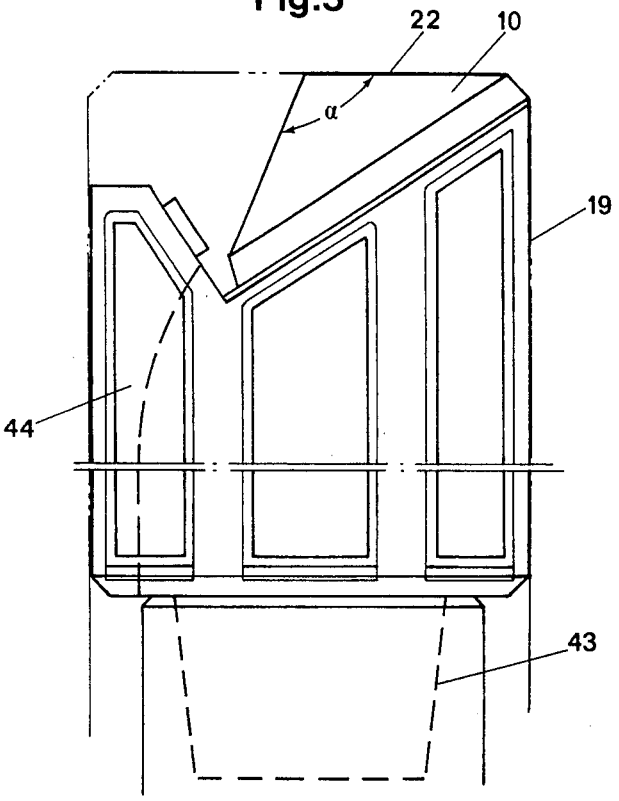
FIG. 5 shows the invention applied as an independently working unit.

In the application of the invention shown in FIG. 5 the cutter bit 10 is an independently working unit. The bit body 19 carrying the cutter bit 10, then, is adapted to be connected to a drill string 43 in a manner known per se. Guide bars 44 are provided on at least the portion of the bit body diametrically opposed to the cutter bit 10 for taking up unbalancing forces acting on the drill bit and created by the cutter bit. Suitably, however, guide bars 44 are spaced around the whole bit body.

I claim:

1. Rotary cutter bit having a generally conical envelope surface carrying a plurality of circumferentially extending rows of cutting elements for cutting circular grooves in a working surface of a formation being cut, said cutter bit adapted to be rotatably carried by a bit body, said envelope surface defining a cone extension measured along a circle formed by one said row of cutting elements when said envelope surface is unrolled in the working surface, said cone extension covering only a portion of said circle, said cone angle exceeding 90° by such an amount that the remaining portion of said circle has a circumferential length whose value is no less than four and no greater than twelve times the pitch of said cutting elements of said one row and being other than an integer multiple of said pitch, said pitch defined as the distance between centers of adjacently disposed cutting elements in said one row, whereby said cutting elements avoid entering already-formed grooves.

2. A rotary cutter bit according to claim 1, wherein said one row is the radially outermost row of cutting elements.

3. A rotary cutter bit according to claim 1, wherein the cutting elements comprise inserts.

4. A rotary cutter bit according to claim 3, wherein cutting inserts each have a dimension in the circumferential direction of said one row, said pitch having a value from about the value of said dimension to about twice the value of said dimension.

5. A rotary cutter bit according to claim 4, wherein said inserts have a circular cross-section, said pitch being equal to the diameter of said inserts.

6. A rotary cutter bit according to claim 5, wherein said rows of inserts form concentric circles, said inserts being chisel-shaped with chisel edges thereof oriented in said circumferential direction.

7. A rotary cutter bit according to claim 1, including two friction bearings for rotatably mounting said cutter bit to a drill bit, one of said friction bearings being conical and extending parallel to said envelope surface, and the other friction bearing being cylindrical and co-axial with the rotary axis of said cutter bit.

8. A rotary boring head rotatable about an axis and comprising supporting means, a plurality of roller cutters carried by said supporting means for common rotation about said axis, each of said roller cutters having a generally cylindrical envelope surface carrying a plurality of circumferentially extending rows of cutting elements, a first of said roller cutters arranged to engage a working surface of a formation at a first section thereof disposed nearest to said axis whereby said rows of cutting elements cut circular grooves in said section of said working surface, said envelope surface defining a cone extension measured along a circle formed by one said row of cutting elements when said envelope surface is unrolled in the working surface, said cone extension covering only a portion of said circle, said cone angle exceeding 90° by such an amount that the remaining portion of said circle has a circumferential length whose value is no less than four and no greater than twelve times the pitch of said cutting elements of said one row and being other than an integer multiple of said pitch, said pitch defined as the distance between centers of adjacently disposed cutting elements in said one row, whereby said cutting elements avoid entering already-formed grooves.

9. A rotary boring head according to claim 8 including a second roller cutter arranged to engage a second section of said working surface situated immediately radially outside of said first section, said first and second roller cutters including axially forwardmost portions which lie in a common imaginary plane disposed perpendicularly to said axis.

* * * * *